US005395233A

United States Patent [19]

Karp

[11] Patent Number: 5,395,233

[45] Date of Patent: Mar. 7, 1995

[54] POTPOURRI DECORATIVE CANDLE AND METHOD OF MAKING SAME

[75] Inventor: Randy Y. Karp, Long Grove, Ill.

[73] Assignee: Scentex, Inc., Chicago, Ill.

[21] Appl. No.: 182,970

[22] Filed: Jan. 18, 1994

[51] Int. Cl.[6] ..... F23D 3/16

[52] U.S. Cl. ..... 431/289; 431/126

[58] Field of Search ..... 431/288, 289, 291, 126

[56] References Cited

U.S. PATENT DOCUMENTS 3,898,039 8/1975 Lin ..... 431/288

4,427,366 1/1984 Moore ..... 431/291

*Primary Examiner*—Carroll B. Dority

*Attorney, Agent, or Firm*—Welsh & Katz, Ltd.

[57] ABSTRACT

A decorative candle combination and a method of making the candle, comprising a core of wax material surrounding a wick, a shell of transparent wax surrounding the core and forming a gap between the core and the shell, and a mixture of potpourri and additional transparent wax surrounding and substantially suspending the potpourri in the additional transparent wax, the potpourri being visible through the shell and the additional transparent wax. The invention also comprises novel methods of constructing the above-described candle.

9 Claims, 2 Drawing Sheets

FIG. 5
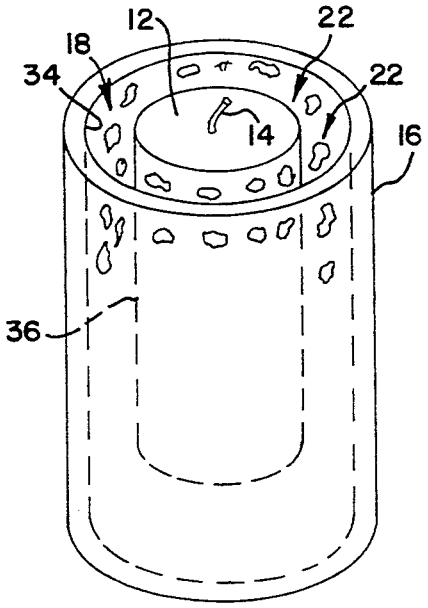
FIG. 6
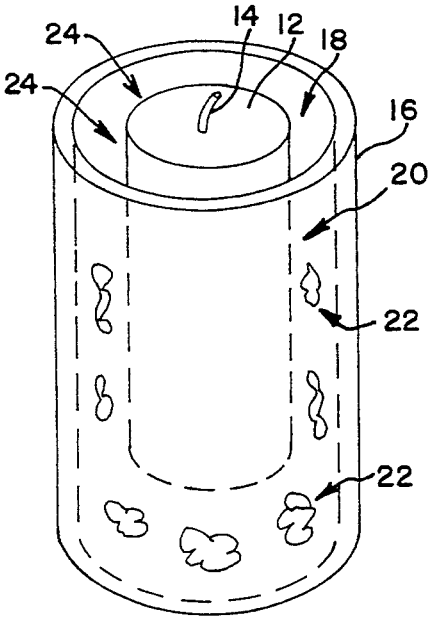
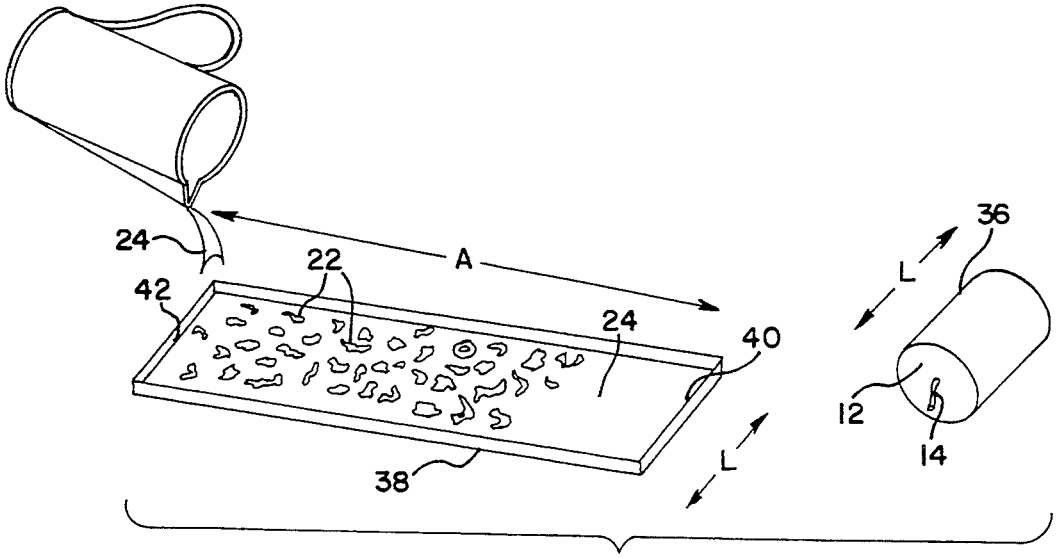
FIG. 7

POTPOURRI DECORATIVE CANDLE AND METHOD OF MAKING SAME

The present invention relates to a decorative potpourri candle and the methods of producing same, and more particularly to a candle construction which incorporates potpourri suspended in a transparent wax substance between a candle core and a transparent shell surrounding the core.

BACKGROUND OF THE INVENTION

Many varieties of fragranced candles are widely manufactured and used today to provide sources of warm, soft light and a pleasing aroma to the environment, such as a room, in which such candles are used. Certain of these candles are made of a wax substance surrounding a wick, with fragrance chemicals or oils dispersed through the wax substance. As the wick burns, the wax substance melts, and the fragrance is emitted into the surrounding atmosphere as the flame heats the wax and the fragrance chemicals. In some candles of this nature, the fragrance material may be carried in an outer casing which surrounds a central core of the candle.

Additionally, potpourri consisting of dried fragrant botanical substances, has gained widespread popularity for use in providing a pleasing scent to an environment, such as a room in a home. Dried botanical potpourri provides a scent sui sponte, and does not require heating to release its pleasing aroma. Another advantage of potpourri is its decorative appearance, consisting of multi-colored and multi-shaped elements of dried flowers, plants, herbs, twigs, leaves, and the like.

To provide a decorative appearance to their fragrance candles, some present producers have encased or inserted their candles into decorative outer containers, typically made of glass or a ceramic material, with the decoration provided by etchings on the glass or painted figures on the glass or ceramic outer surface. This results in added material cost in producing the candle, as well as increasing the weight of the final product.

There presently does not exist a relatively economically produced combination fragranced candle with potpourri used to provide decoration for the candle.

Therefore, an object of the present invention is to provide an economical method of producing a fragranced candle, which incorporates potpourri as a decorative element of the candle.

Another object of the present invention is to provide a fragranced candle having a mixture of clear wax and potpourri surrounding a fragranced wax core.

Yet another object of the present invention is to provide a candle having a gap formed between a transparent wax shell and a fragranced wax core, and a mixture of transparent wax and potpourri inserted in the gap to provide a decorative outer portion of the candle.

A further object of the invention is to provide a method of producing a fragranced candle which includes surrounding a fragranced core of the candle with a strip formed of a mixture of transparent wax and potpourri, and joining the ends of the strip in a common seam such that the strip is maintained in place over the candle core and the potpourri is visible through the clear wax forming the strip.

SUMMARY OF THE INVENTION

The above objects are accomplished by the present invention which provides a potpourri candle, and processes for producing a potpourri candle, comprising a geometric core of wax surrounding a wick, a shell of transparent wax surrounding the core and forming a gap between the core and the shell, and a mixture of potpourri and additional transparent wax in the gap. The additional transparent wax surrounds and substantially suspends the potpourri wax, and the potpourri is visible through the shell and additional transparent wax to provide a decorative expression of the candle to a viewer.

The novel process of producing the above-described candle, in a first embodiment, comprises the steps of producing a geometric shaped core of wax surrounding a wick, the core having an outside dimension; and producing a shell of transparent wax, the shell having a geometric shape corresponding to the shape of the core. The shell also has an internal opening with an inside dimension larger than the outside dimension of the core. The core is placed in the internal opening of the shell, forming a gap between the core and the internal wall of the shell. Potpourri elements are inserted in the gap, and transparent wax is added to the gap to surround and suspend the potpourri in the wax between the core and the shell. The potpourri is visible through the shell and the transparent wax in the gap.

In a second embodiment of the method of producing the potpourri candle of the present invention, a geometric shaped core of wax is formed surrounding a wick, the core having an outer surface. Molten transparent wax is poured into a receptacle which has one dimension substantially the same as a lateral circumferential dimension of the outer surface of the core, and potpourri is placed in the molten transparent wax in the receptacle such that the transparent wax surrounds and substantially suspends the potpourri in the transparent wax to form a potpourri and transparent wax mixture. The potpourri and wax mixture is cooled until the mixture reaches a substantially solid, warm state. The substantially solid mixture is wrapped around the outer surface of the core until the opposite edges of the mixture abut each other, and a seam is formed between the opposite edges of the mixture. The potpourri is visible through the transparent wax.

BRIEF DESCRIPTION OF THE DRAWINGS

The above objects, advantages and features of the invention can be ascertained from the following detailed description of the preferred embodiments thereof, taken in conjunction with the figures of the appended drawings, wherein:

FIG. 5 is a perspective assembly view similar to FIG. 4 showing the insertion of potpourri in the gap between the shell and the core of the candle of the present invention;

FIG. 6 is a perspective assembly view similar to FIGS. 4 and 5 illustrating the introduction of molten transparent wax into the gap between the shell and core of the candle of the present invention; and FIG. 7 is an illustration of certain steps of an alternate embodiment for forming a potpourri candle in accordance with the teachings of the present invention.

DETAILED DESCRIPTION OF THE PREFERRED EMBODIMENTS

Figure 1:
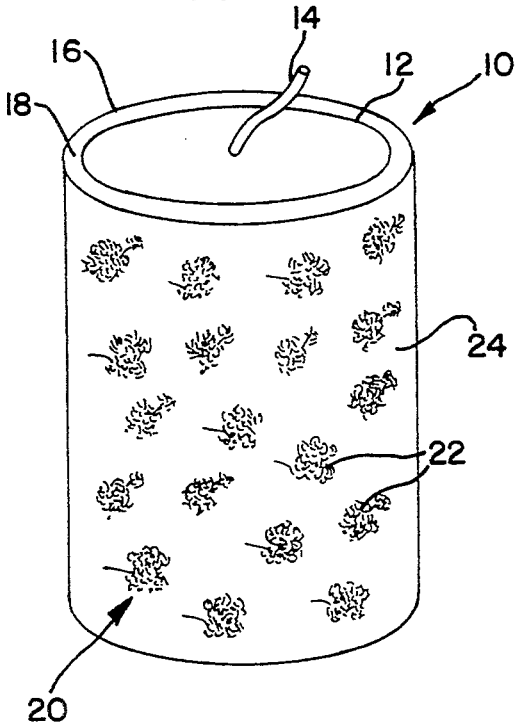
FIG. 1 is a perspective elevation view of a potpourri candle comprising the present invention and produced in accordance with the method of the present invention.
Figure 2:
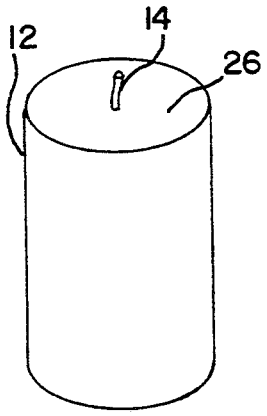
FIG. 2 is a perspective elevation view of the core and wick forming part of the candle of the present invention.

FIG. 1 illustrates a stand-alone candle 10. The candle 10 comprises a core 12 made of paraffin wax, or any other suitable wax substance. The core 12 is impregnated with fragrance chemicals or oils which emit a pleasant aroma both before and after the candle is lit, as is well known in the candle making art. The core 12 centrally surrounds a wick 14.

The outer surface of the candle 10 is surrounded by a thin shell 16 made of a transparent wax substance, such as clear paraffin wax, such that the shell 16 is substantially transparent. The thickness of shell 16 can be variable, however the shell wall should not be thick enough to impede the passage of light through the shell. The lengths of shell 16 and core 12 are coextensive. The shell 16 has an inner surface which extends radially outward beyond the outer surface of core 12, forming a gap 18 between shell 16 and core 12. Preferably the gap 18 is in the range of one-eighth to one-quarter inch wide, but could be otherwise dimensioned depending upon the overall size of potpourri candle 10.

The gap 18 contains a mixture 20 of potpourri 22 and transparent wax 24. The potpourri 22 comprises multicolored and multi-shaped elements of dried flowers, plants, herbs, twigs, leaves and other botanical matter. Each element of potpourri is surrounded by and substantially suspended in the transparent wax 24. The potpourri 22 is visible through the transparent wax forming the shell 16, and through the transparent wax 24 in the gap 18.

One embodiment of a process for producing the potpourri candle 10 of FIG. 1 is illustrated in FIGS. 2–6. The initial step in the process is the fabrication of the core 12 surrounding the wick 14. The core is preferably made of paraffin wax, or any other suitable material known in the candle making art. The candle 10 is shown in FIGS. 1–6 as being constructed in the shape of a cylinder, however the candle 10 can be formed in any suitable geometric shape, such as oval, square, rectangular, or any other desired shape. The top 26 of the core 12 is preferably flat or convex in configuration.

Figure 3:
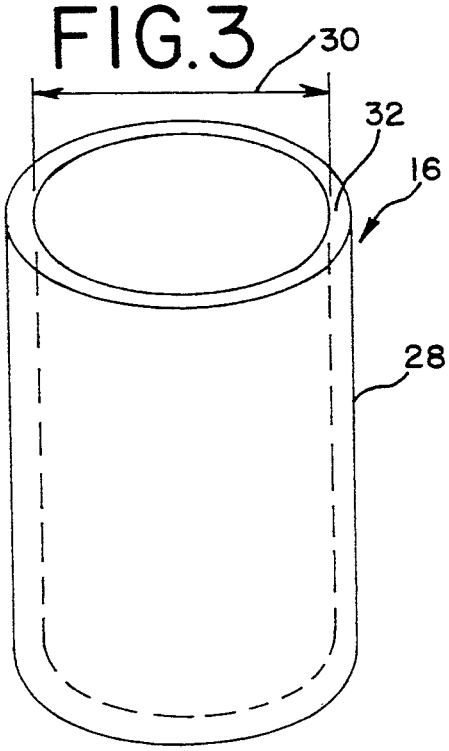
FIG. 3 is a perspective elevation view of the transparent shell forming part of the present invention.

The next step in the process of producing candle 10 (FIG. 1) is to fabricate shell 16. Referring to FIG. 3, shell 16 is made of a transparent paraffin wax in the shape of a hollow cylinder. The shell 16 has an outer surface 28 and an inner dimension or inner diameter measurement 30. Inner diameter 30 is larger than the diameter of core 12 (FIG. 1). The thickness 32 of the shell may vary, but should be such that potpourri 22 is visible through shell 16. Shell 16 can be formed by applying molten paraffin to a cylindrical drum, or by other means known in the candle making art. The length of shell 16 is preferably the same as the length of core 12 (FIG. 1).

Figure 4:
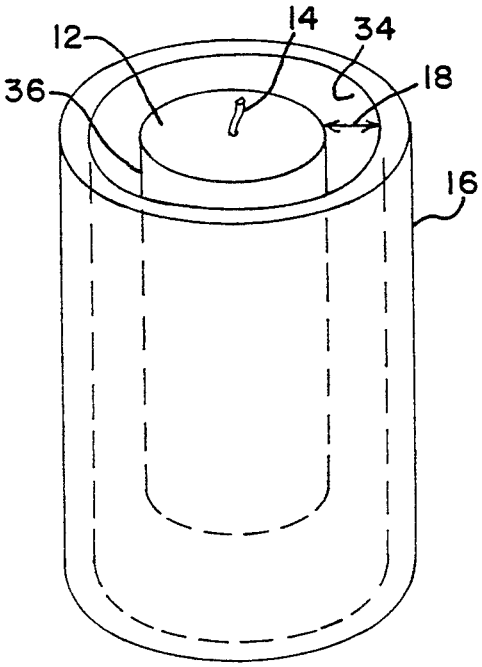
FIG. 4 is a perspective assembly view showing the placement of the candle core inside the shell of the present invention and the gap formed between the core and the shell.

The next step in the process of producing candle 10 is to place core 12 centrally and co-axially into shell 16 (FIG. 4). Gap 18 is formed between the inner surface 34 of shell 16 and the outer surface 36 of core 12. Referring to FIG. 5, potpourri elements 22 are inserted into gap 18. Since gap 18 is from one-eighth to one-quarter inch in width, some of the potpourri 22 will be wedged between outer surface 36 of core 12 and inner surface 34 of shell 16 and will be lodged at different points along the vertical and circumferential extent of gap 18. Other smaller elements of potpourri 22 may fall to or near the bottom of gap 18.

Next, referring to FIG. 6, molten transparent wax 24 is inserted into gap 18, such that the molten transparent wax surrounds and substantially suspends each element of potpourri 22 in gap 18. Wax 24 is preferably a clear paraffin wax, or any other suitable transparent wax. Sufficient molten transparent wax 24 is added to reach the top of gap 18. The wax 24 is then allowed to cool to a solid state to form the completed candle 10. The potpourri 22 remains visible through the transparent wax forming shell 16 and the transparent molten wax in gap 18.

An alternate embodiment of a process for producing the candle 10 (FIG. 1) is schematically illustrated in FIG. 7. In the alternative embodiment, a core 12 is formed, surrounding a wick 14, as described regarding the embodiment of FIGS. 2–6. The core 12 has a length L. The process of this embodiment includes using a receptacle or tray 38 which has a lateral width L equal to the length L of core 12, and a length A equal to the circumferential distance around the outer surface 36 of core 12. Receptacle 38 also has a height of between one-eighth and one-quarter inch.

To produce a potpourri candle using the alternate embodiment of FIG. 7, receptacle 38 is filled with molten transparent wax 24. Potpourri elements 22 are then randomly inserted into the molten transparent wax 24. The molten transparent wax is cooled to a solid, but still warm, state, and rolled or wrapped around the outer surface 36 of core 12 such that the opposite ends 40, 42 of the wax roll abut each other. Next, a smooth seam is formed by passing a hot knife or other suitable heating element along the joint formed by abutting ends 40 and 42. The potpourri candle made by the alternate process is thus complete.

Upon use of the candle, the wick 12 is lit and a pool of molten wax is formed in the central part of core 12. Under usual burning conditions, the pool of molten wax does not reach the outer edges of core 12, and therefore does not contact the mixture 20 of potpourri 22 and transparent wax 24 surrounding the core 12. The decorative potpourri remains in place, and visible through shell 16 and the transparent molten wax 24 in the candle formed in accordance with the process of the first embodiment. When the candle is formed using the process of the alternate embodiment (FIG. 7), the potpourri 22 and molten wax 24 remains in a stable position as the candle wick burns, maintaining the integrity and decorative ambiance of the candle provided by the visible potpourri.

While preferred embodiments of processes for producing a novel potpourri candle have been illustrated and described, it will be understood that changes and modifications may be made therein without departing from the invention and its broader aspects. Various features of the invention are defined by the following claims.

I claim:

1. A process for producing a potpourri candle comprising the steps of:

producing a geometrically shaped core of wax surrounding a wick and having an outside dimension;

producing a shell of transparent wax, said shell having a geometric shape corresponding to the shape of said core, said shell also having an internal opening, said opening having an inside dimension larger than said outside dimension of said core;

placing said core inside said internal opening of said shell and forming a cavity between said core and the internal opening of said shell;

inserting potpourri in said gap and adding transparent wax to said gap to surround and suspend said potpourri in said wax between said core and said shell, said potpourri being visible through said shell and said transparent wax.

2. The method of claim 1 including the additional step of cooling said wax after said transparent wax is added to said gap.

3. The method of claim 1 wherein said geometric shapes of said core and said shell are cylindrical.

4. The method of claim 1 wherein said geometric shapes of said core and said shell are oval.

5. A potpourri candle combination comprising:

a geometric shaped core of wax surrounding a wick;

a shell of transparent wax surrounding said core and forming a gap between said core and said shell;

a mixture of potpourri and additional transparent wax in said gap, said additional transparent wax surrounding and substantially suspending said potpourri in said additional transparent wax, said potpourri being visible through said shell and said additional transparent wax.

6. The potpourri candle combination of claim 4 wherein said geometric shape is a cylinder.

7. The potpourri candle combination of claim 4 wherein said geometric shape is an oval.

8. A method for producing a potpourri candle comprising the steps of:

forming a geometric shaped core of wax surrounding a wick and having an outer surface;

pouring molten transparent wax in a receptacle, said receptacle having one dimension substantially the same as a lateral linear dimension of said outer surface of said core;

placing potpourri in said molten transparent wax in said receptacle, said transparent wax surrounding and substantially suspending said potpourri in said transparent wax to form a potpourri and wax mixture;

cooling said molten transparent wax and potpourri mixture to a substantially solid, warm state;

wrapping said solid transparent wax and potpourri mixture around said outer surface of said core until opposite edges of said mixture abut each other; and forming a seam between said opposite edges of said mixture.

9. A potpourri candle comprising:

a geometric shaped core of paraffin wax surrounding a wick and having an outer surface;

a sleeve comprising a mixture of potpourri and transparent wax extending around said outer surface of said core, said potpourri surrounded by and substantially suspended in said transparent wax.

* * * * *